US011509043B2

(12) United States Patent
Szczotka

(10) Patent No.: US 11,509,043 B2
(45) Date of Patent: Nov. 22, 2022

(54) PASSIVE ENTRY PASSIVE START ANTENNA

(71) Applicant: TDK Electronics AG, Munich (DE)

(72) Inventor: Rafal Szczotka, Solothurn (CH)

(73) Assignee: TDK ELECTRONICS AG, Munich (DE)

( * ) Notice: Subject to any disclaimer, the term of this patent is extended or adjusted under 35 U.S.C. 154(b) by 171 days.

(21) Appl. No.: 16/634,521

(22) PCT Filed: Jul. 24, 2018

(86) PCT No.: PCT/EP2018/070054

§ 371 (c)(1),
(2) Date: Jan. 27, 2020

(87) PCT Pub. No.: WO2019/020635

PCT Pub. Date: Jan. 31, 2019

(65) Prior Publication Data

US 2020/0274237 A1 Aug. 27, 2020

(30) Foreign Application Priority Data

Jul. 28, 2017 (DE) ..... 102017117159.2

(51) Int. Cl.
*H01Q 7/08* (2006.01)
*H01Q 1/32* (2006.01)

(52) U.S. Cl.
CPC ..... *H01Q 1/3241* (2013.01); *H01Q 7/08* (2013.01); *H01Q 1/3283* (2013.01)

(58) Field of Classification Search
CPC ..... H01Q 1/3241; H01Q 7/08; H01Q 1/3283; H01Q 7/06
See application file for complete search history.

(56) References Cited

U.S. PATENT DOCUMENTS

| | | | | |
|---|---|---|---|---|
| 5,907,307 | A * | 5/1999 | Bickert | H01Q 1/245 343/702 |
| 2004/0222804 | A1 | 11/2004 | Inuzuka et al. | |
| 2007/0139288 | A1 | 6/2007 | Shigemoto | |
| 2011/0215987 | A1 | 9/2011 | Ohara et al. | |
| 2014/0308971 | A1* | 10/2014 | O'Brien | H04W 4/023 455/456.1 |
| 2014/0361949 | A1 | 12/2014 | Mahara | |
| 2018/0114107 | A1* | 4/2018 | Verhaeghe | H01Q 1/2208 |

FOREIGN PATENT DOCUMENTS

| | | | | |
|---|---|---|---|---|
| CN | 206313135 | U | 7/2017 | |
| DE | 202005012971 | U1 * | 11/2005 | H01R 13/5221 |
| DE | 102006003999 | A1 * | 8/2007 | H01Q 1/20 |
| EP | 3002766 | A1 | 4/2016 | |
| EP | 3211713 | A1 | 8/2017 | |
| JP | 2007288345 | A * | 11/2007 | |

* cited by examiner

*Primary Examiner* — Dieu Hien T Duong
(74) *Attorney, Agent, or Firm* — Slater Matsil, LLP

(57) ABSTRACT

A passive entry passive start (PEPS) antenna is disclosed. In an embodiment an antenna includes an interface head component and a bobbin component comprising a ferrite core and a wire wound around the ferrite core, the wire being covered by an insulation, wherein the bobbin component and the interface head component are connectable to each other electrically and mechanically, and wherein the antenna is a PEPS antenna.

14 Claims, 2 Drawing Sheets

PASSIVE ENTRY PASSIVE START ANTENNA

This patent application is a national phase filing under section 371 of PCT/EP2018/070054, filed Jul. 24, 2018, which claims the priority of German patent application 102017117159.2, filed Jul. 28, 2017, each of which is incorporated herein by reference in its entirety.

TECHNICAL FIELD

The present invention concerns a passive entry passive start antenna (PEPS antenna). A PEPS system enables hand-free interaction with a vehicle. The passive entry function allows a driver to unlock a door of the vehicle without activating a key fob. When the vehicle detects that the driver is approaching the vehicle, it starts to search for the key fob outside of the vehicle. The passive start function allows the driver to start or stop a vehicle engine without activating the key fob. Once the driver pushes a start/stop button the vehicle starts to localize the key fob inside the car. In order to localize the key fob inside or outside the car, the PEPS antenna sends out a low frequency signal.

BACKGROUND

Strong competition on the market of low frequency PEPS antennas is causing pressure to cut high costs. However, the quality requirements regarding environmental durability have to be fulfilled.

PEPS antennas which are commercially available on the market comprise an enamelled wire which is wound around a carrier and a ferrite core. As the enamelling provides only minimal protection against environmental influences, the antenna is further encapsulated in a housing or by a potting material.

SUMMARY OF THE INVENTION

Embodiments provide an improved PEPS antenna which is reliable and which minimizes the amount of protective material required. Moreover, further embodiments provide an antenna for a convenient assembly of the vehicle.

A PEPS antenna is proposed which comprises an interface head component and a bobbin component. The bobbin component comprises a ferrite core and a wire which is wound around the ferrite core, wherein the wire is covered by an insulation. The bobbin component and the interface head component can be connected to each other electrically and mechanically.

The bobbin component and the interface head component can be manufactured as two separate components. They can be assembled to each other during the assembly of the PEPS antenna. Thus, the PEPS antenna can be a modular device. The modular design of the PEPS antenna provides a high design freedom.

A modular system of different bobbin components and different interface head components is possible wherein each of the bobbin components can be connected electrically and mechanically to each of the interface head components. Thus, for each application of the PEPS antenna, one bobbin component of a multitude of different bobbin components and one interface head component of a multitude of different interface head components can be selected and the selected bobbin component can be connected to the selected interface head component to form a PEPS antenna which is optimized for the requirements of the specific application.

The bobbin component comprises a ferrite core and a wire which is wound around the ferrite core. Different bobbin components may differ from each other in a number of windings and/or in the material of the ferrite core. The ferrite core can be designed to magnify an electromagnetic field emitted by the wire.

The interface head component may comprise further elements of the PEPS antenna. In particular, the interface head component may comprise electronic components which are configured to apply a signal to the wire. The interface head component may comprise an interface for connecting the PEPS antenna to a PEPS system of a vehicle. In particular, the PEPS antenna may be connected to the PEPS system mechanically and electrically via the interface of the interface head component.

The bobbin component and the interface head component can be connected to each other electrically and mechanically. The connection of the bobbin component and the interface head component can be releasable. Thus, the bobbin component and the interface head component may be designed such that they can be separated from each other without damaging one of the components.

The wire which is covered by an insulation. In contrast to an enamelled wire, the insulation of the wire may provide a proper protection of the wire against environmental impacts. In particular, no potting material and no housing for the PEPS antenna may be required to protect the wire from environmental influences like temperature, humidity, dust or splashes of water. Thereby, the amount of protective material required for the PEPS antenna may be significantly reduced.

The PEPS antenna is fully electrically and magnetically functional. It can be assembled on the vehicle in a convenient assembly process.

The insulation of the wire can ensure a high durability and thus a long lifetime of the PEPS antenna. As only a low amount of material is required for the insulation to protect the wire, high quality materials can be used without significantly increasing the costs.

The insulation can comprise a plastic material. The plastic material can be insulating. The plastic material can surround and insulate a conductive core of the wire.

The plastic material of the insulation may comprise at least one of a fluorinated ethylene propylene (FEP), an ethylene tetrafluoroethylene (ETFE) and a thermoplastic elastomer (TPE). Each of these materials provides an insulation which ensures electrical insulation and protection against environmental impacts, e.g., high temperatures and a high humidity.

The bobbin component comprising the wire covered by the insulation can be exposed to an environment of the antenna. Accordingly, the PEPS antenna may not comprise any additional means except for the insulation to protect the wire from the environment and from environmental impacts like high or low temperatures or a high humidity. Instead, the insulation can provide sufficient protection for the wire.

According to a preferred embodiment, the bobbin component is neither encapsulated by a potting nor by a housing. In this state, the PEPS antenna can be assembled into a vehicle.

The insulation of the wire can be sufficiently thick to provide a protection of the wire against environmental impacts.

The antenna can comprise passive components. The interface head component can comprise an IP68 protected room, wherein the passive electronic components are arranged inside the IP68 protective room. The IP code classifies and rates the degree of protection provided against intrusion, dust, accidental contact and water by mechanical casings and electrical enclosures. Accordingly, the passive components can be properly protected against intrusion, dust, accidental contact and water inside the IP68 protected room. The IP68 protected room may be filed with a potting material. The potting material filling the IP68 protected room may be the only potting material used for the PEPS antenna.

The wire can be arranged outside the IP68 protected room as it comprises the insulation of the plastic material and is, therefore, already sufficiently protected against environmental influences. As the wire is arranged outside the IP68 protected room, the amount of material encapsulating the IP68 protected room can be significantly reduced as the IP68 protected room can be designed to be small.

The interface head component may comprise a first mechanical and electrical interface and the bobbin component may comprise a second mechanical and electrical interface, which is connected to the mechanical and electrical interface of the interface head component. The first and the second mechanical and electrical interface can be formed by any kind of mechanism that allows connecting two components mechanically and electrically. In a preferred embodiment, one of the first and the second mechanical and electrical interface is a plug and the other of the first and the second mechanical and electrical interface is a socket corresponding to the plug. A plug and socket mechanism can be connected and separated very fast and easy.

In particular, the wire comprises two ends. The ends of the wire may be arranged at the second mechanical and electrical interface and may be connected to the first mechanical and electrical interface, when the bobbin component and the interface head component are connected to each other. Thus, the ends of the wire may be connected to a passive electronic component inside the IP68 protected room via the first and the second interface.

The interface head component can comprise an integral interface which is adapted and arranged to be connected to a corresponding interface of a PEPS system of a vehicle and to provide an electric connection to the electronic system of the vehicle. The integral interface can comprise a mechanical interface comprising an opening extending into the carrier and/or the mechanical interface can comprise a clipping mechanism for a connector of a PEPS. Moreover, the integral interface may comprise a terminal which provides an electric connection of the interface head component and the electronic system of the vehicle. In particular, the terminal may connect the electronic components inside the IP68 protected room to the electronic system of the vehicle. Thus, the integral interface can provide a mechanical and electric connection to the PEPS system of the vehicle.

The interface head component may be an integration component comprising all interfaces for the bobbin component. All further elements of the antenna, apart from the wire and the ferrite core, may be attached to and/or arranged inside the interface head component.

The bobbin component and the interface head component can form a modular antenna, wherein all elements of the antenna are fixed either to the bobbin component or the interface head component. The elements may also be arranged inside the bobbin component or the interface head component. The elements of the antenna can, in particular, include the wire, the IP68 protected room and the passive electric components inside the IP68 protected room, the integral interface and the terminal being adapted and arranged to be connected to the electronic system of a PEPS system of a vehicle.

In order to assemble the PEPS antenna into a vehicle, it may be sufficient to connect the bobbin component to the interface head component, to place the connected components inside the vehicle, to connect the integral interface to a corresponding interface of the PEPS system of the vehicle. Thus, the PEPS antenna may be assembled in a simple process which enables a fast workflow for the assembler.

The wire can have a diameter in the range of 0.079 mm to 0.5 mm. 0.079 mm is the minimum diameter of a wire having a full insulation that is resistant to environmental impacts. In principle, the maximum diameter of the wire is only limited by the overall dimension of the antenna.

Embodiments of the present invention relate to a system comprising a first bobbin component, a second bobbin component a first interface head component and a second interface head component. Each of the first bobbin component and the second bobbin component can be connected mechanically and electrically to each of the first interface head component and the second interface head component, wherein a PEPS antenna as described above is formed by connecting one of the interface head components mechanically and electrically with one of first bobbin component or the second bobbin component.

Each of the first bobbin component and the second bobbin component may correspond to the above-discussed bobbin component. Each of the first interface head component and the second interface head component may correspond to the above-described interface head component. Thus, each structural and functional feature that is disclosed above with respect to the bobbin component may also apply to one or both of the first bobbin component and the second bobbin component. Each structural and functional feature that is disclosed above with respect to the interface head component may also apply to one or both of the first interface head component and the second interface head component.

The first and the second bobbin component may differ from each other, for example with respect to a number of windings of the wire and/or the material of the ferrite core.

The first and the second interface head component may differ from each other, for example the first interface head component may comprise other passive electric components than the second interface head component.

For each application of the PEPS antenna, a suitable bobbin component and a suitable interface head component may be chosen and connected to each other to form the PEPS antenna.

Further embodiments of the present invention relate to an arrangement comprising the above-described antenna and a PEPS system of a vehicle. The PEPS system comprises a mechanical interface configured to be mechanically connected to the antenna and an electronic system comprising a terminal configured to be electrically connected to a terminal of the antenna.

BRIEF DESCRIPTION OF THE DRAWINGS

In the following, the invention is described in more detail with reference to the figure.

DETAILED DESCRIPTION OF ILLUSTRATIVE EMBODIMENTS

Figure 1:
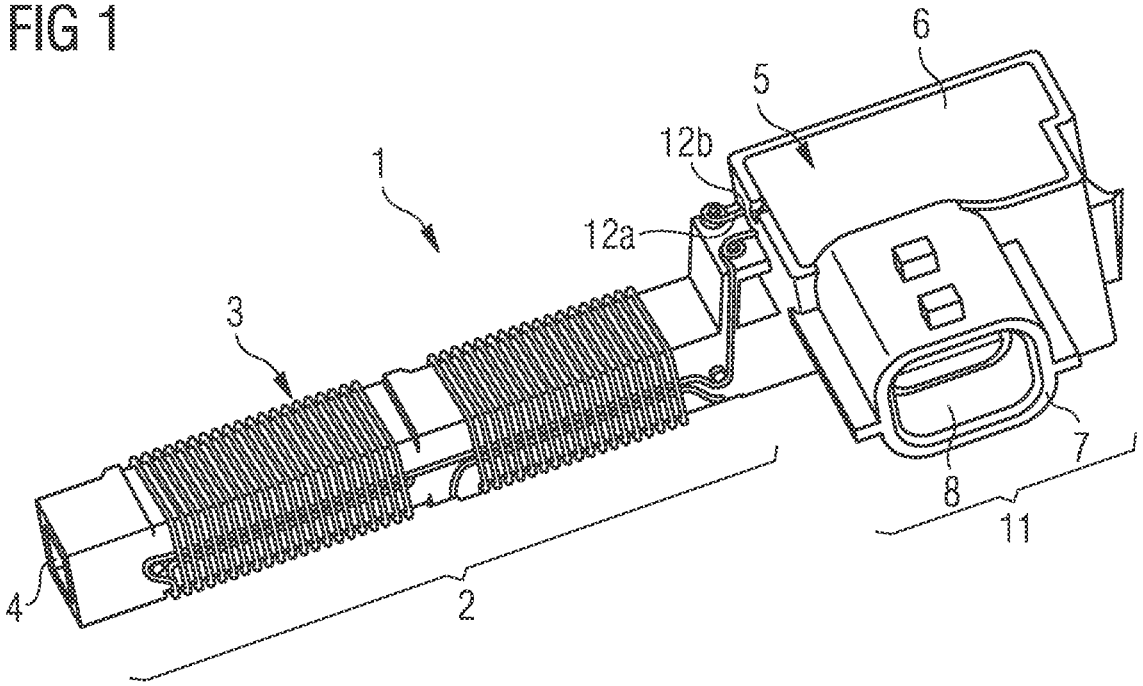
FIG. 1 shows a perspective view of a PEPS antenna.

FIG. 1 shows a passive entry passive start antenna (PEPS antenna) 1. The antenna 1 comprises a bobbin component 2 and an interface head component 11. All further components of the antenna 1 are arranged either on or in the bobbin component 2 or on or in the interface head component 11. The antenna 1 is adapted and arranged to be installed inside a vehicle and to form a part of a PEPS system of the vehicle. In particular, the antenna 1 is adapted and arranged to emit a low frequency signal.

The bobbin component 2 and the interface head component 11 are mechanically and electrically connected to each other. The interface head component 11 comprises a first mechanical and electrical interface 12*a*. The first mechanical electrical interface 12*a* is a socket in the embodiment shown in FIG. 1. The bobbin component 2 comprises a second mechanical and electrical interface 12*b*. The second mechanical and electrical interface 12*b* is a plug in the embodiment shown in FIG. 1. In an alternative embodiment, the first mechanical electrical interface 12*a* is a plug and the second mechanical and electrical interface 12*b* is a socket.

The PEPS antenna 1 is a modular device. Before assembling the PEPS antenna 1 into a vehicle, the bobbin component 2 and the interface head component 11 can be releasably fixed to each other.

The interface head component 11 provides an interface and a platform for all further components of the PEPS antenna 1 apart from a wire 3 and a ferrite core 4.

The bobbin component 2 comprises the wire 3 and the ferrite core 4. The wire 3 is wound around the ferrite core 4. The wire 3 forms a coil. The wire 3 is covered with an insulation 10 which consists of an insulating material. The insulating material comprises a plastic material. The insulation 10 provides an environmentally protected insulation for the wire 3. In particular, the insulating material has a thickness that ensures that the wire 3 is protected from environmental influences, e.g., temperatures, humidity, dust or splashes of water.

The wire 3 is exposed on the bobbin component 2. This means that the bobbin component 2 does not comprise any potting material or a housing which encapsulates the wire. Thereby, a significant amount of material can be omitted.

The coil, which is formed by the wire 3, is wound around the ferrite core 4. The ferrite core 4 magnifies an electromagnetic field emitted by the wire 3.

The interface head component 11 further comprises a cavity which forms an IP68 protected room 5. Inside the IP68 protected 5 room passive electronic components are arranged. The IP68 protected room 5 is further filled by a potting material 6 which provides the IP68 protection. The potting material 6 may comprise an epoxy resin or a silicon. The potting material 6 arranged inside the IP68 protected room 5 is the only potting material of the PEPS antenna 1.

Further, the interface head component 11 comprises an integral interface 7 which is adapted and arranged to provide a connection to the PEPS system of the vehicle. The integral interface 7 comprises a mechanical interface which is configured to provide a mechanical connection to the PEPS system. For this purpose, the mechanical interface comprises an opening 8. The mechanical interface comprises an ear-shape which defines the opening 8. The opening 8 is configured to receive a corresponding counter-part of a mechanical interface of the PEPS system of the vehicle. Further, the integral 7 interface is designed to provide an electronic connection to the electronic system of the vehicle. For this purpose, the integral interface 7 comprises a terminal for providing the electronic connection. The terminal may be arranged inside the opening 8.

Alternatively or additionally, the mechanical interface may comprise a clipping mechanism.

Figure 2:
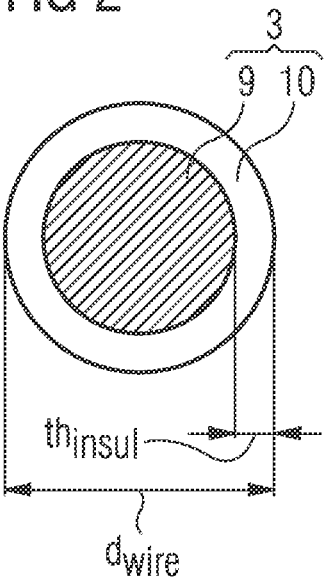
FIG. 2 shows a wire with an insulation in a cross-sectional view.

FIG. 2 shows a schematic cross-sectional view of the wire 3. The wire 3 comprises a conductive core 9 consisting of a conductive material and the insulation 10 which surrounds the conductive core 9.

As FIG. 2 is a schematic figure, it is not true to scale. The thickness $th_{insul}$ of the insulation 10 may be in the range of 0.1% to 10% of the diameter $d_{wire}$ of the wire 3. The thickness $th_{insul}$ of the insulation 10 is chosen to be thick enough to provide a sufficient protection for the conductive core 9.

Figure 3:
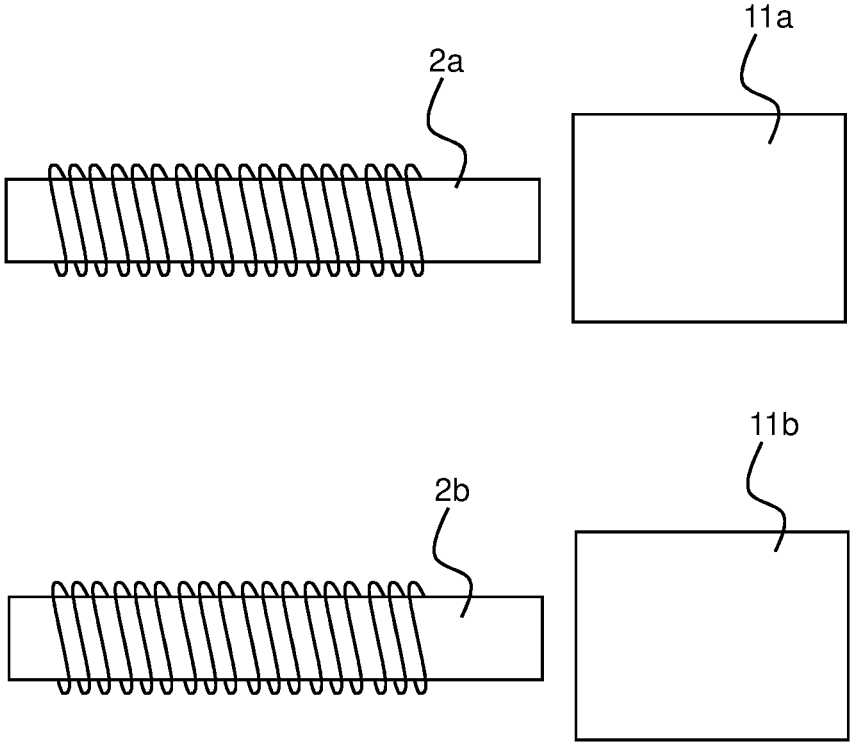
FIG. 3 shows a first bobbin component, a second bobbin component, a first interface head component and a second interface head component.

FIG. 3 shows a first bobbin component 2*a*, a second bobbin component 2*b*, a first interface head component 11*a* and a second interface head component 11*b*. Each of the first bobbin component 2*a* and the second bobbin component 2*b* can be connected mechanically and electrically to each of the first interface head component 11*a* and the second interface head component 11*b*.

I claim:

1. An antenna comprising:

an interface head component; and a bobbin component comprising a ferrite core and a wire wound around the ferrite core, the wire being covered by an insulation, wherein the bobbin component and the interface head component are connectable to each other electrically and mechanically, wherein a connection of the bobbin component and the interface head component is releasable, wherein the interface head component comprises electronic components configured to apply a signal to the wire, wherein the antenna is a passive entry passive start (PEPS) antenna, wherein the interface head component comprises an integral interface configured to be mechanically fixed to a corresponding mechanical interface of a PEPS system of a vehicle, and wherein a direction of the connection of the bobbin component and the interface head component is perpendicular to a direction of the connection of the interface head component to the mechanical interface of the PEPS system.

2. The antenna according to claim 1, wherein the insulation comprises a plastic material.

3. The antenna according to claim 2, wherein the plastic material of the insulation comprises at least one of a fluorinated ethylene propylene, an ethylene tetrafluoroethylene or a thermoplastic elastomers.

4. The antenna according to claim 1, wherein the bobbin component comprising the wire covered by the insulation is exposed to an environment of the antenna.

5. The antenna according to claim 1, wherein the bobbin component is neither encapsulated by a potting material nor by a housing.

6. The antenna according to claim 1, wherein the insulation of the wire is sufficiently thick to provide a protection of the wire against environmental impacts.

7. The antenna according to claim 1, wherein the antenna comprises passive electronic components, wherein the interface head component comprises an IP68 protected room, and wherein the passive electronic components are arranged inside the IP68 protected room.

8. The antenna according to claim 1, wherein the interface head component comprises a first mechanical and electrical interface, and wherein the bobbin component comprises a second mechanical and electrical interface which is connected to the first mechanical and electrical interface of the interface head component.

9. The antenna according to claim 8, wherein one of the first mechanical and electrical interface or the second mechanical and electrical interface is a plug and the other of the first mechanical and electrical interface or the second mechanical and electrical interface is a socket corresponding to the plug.

10. The antenna according to claim 8, wherein the wire comprises two ends, and wherein the ends of the wire are arranged at the second mechanical and electrical interface and are connected to the first mechanical and electrical interface when the bobbin component and the interface head component are connected to each other.

11. The antenna according to the claim 1, wherein the integral interface comprises a mechanical interface, wherein the mechanical interface comprises an opening, and/or wherein the mechanical interface comprises a clipping mechanism for a connector of the PEPS.

12. The antenna according to claim 1, wherein the wire has a diameter in a range of 0.079 mm to 0.5 mm.

13. A system comprising:

a first bobbin component comprising a first ferrite core and a first wire wound around the first ferrite core, the first wire being covered by a first insulation;

a second bobbin component comprising a second ferrite core and a second wire wound around the second ferrite core, the second wire being covered by a second insulation;

a first interface head component comprising first electronic components configured to apply a first signal to the first wire or the second wire; and a second interface head component comprising second electronic components configured to apply a second signal to the first wire or the second wire, wherein each of the first bobbin component and the second bobbin component is connectable mechanically and electrically to each of the first interface head component and the second interface head component, wherein a connection of the first bobbin component or the second bobbin component and the first interface head component or the second interface head component is releasable, wherein an antenna is formed by connecting one of the first interface head component or the second interface head component mechanically and electrically with one of first bobbin component or the second bobbin component, wherein the antenna is a passive entry passive start (PEPS) antenna, wherein each of the first and second interface head components comprises an integral interface configured to be mechanically fixed to a corresponding mechanical interface of a PEPS system of a vehicle, and wherein directions of the connections of the first and second bobbin components and the first and second interface head components are perpendicular to directions of the connections of the first and second interface head components to the mechanical interfaces of the PEPS system.

14. An arrangement comprising:

the antenna according to claim 1; and the PEPS system of the vehicle, wherein the PEPS system of the vehicle comprises an electronic system comprising a terminal configured to be electronically connected to a terminal of the antenna.

* * * * *